US012680489B2

(12) United States Patent
Okumoto

(10) Patent No.: US 12,680,489 B2
(45) Date of Patent: Jul. 14, 2026

(54) TRACTOR

(71) Applicant: Kubota Corporation, Osaka (JP)

(72) Inventor: Yasunori Okumoto, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 19/038,762

(22) Filed: Jan. 28, 2025

(65) Prior Publication Data

US 2025/0250923 A1 Aug. 7, 2025

(30) Foreign Application Priority Data

Feb. 1, 2024 (JP) ..... 2024-014391

(51) Int. Cl.
*F01N 9/00* (2006.01)

(52) U.S. Cl.
CPC ..... *F01N 9/00* (2013.01); *F01N 2340/04* (2013.01); *F01N 2590/08* (2013.01)

(58) Field of Classification Search
CPC .. F01N 2340/04; F01N 2590/08; B60K 13/04
See application file for complete search history.

(56) References Cited

U.S. PATENT DOCUMENTS

| | | | | |
|---|---|---|---|---|
| 9,004,210 | B2 | | 4/2015 | Kim |
| 2015/0233329 | A1 | | 8/2015 | Morey |
| 2018/0222313 | A1 | | 8/2018 | Takii |
| 2023/0118454 | A1 | | 4/2023 | Tsuji et al. |

FOREIGN PATENT DOCUMENTS

| | | | | |
|---|---|---|---|---|
| JP | 2012201159 | A | 10/2012 | |
| JP | 5621529 | B2 * | 11/2014 | ..... B63H 21/32 |
| JP | 2023051493 | A | 4/2023 | |
| JP | 2023080715 | A | 6/2023 | |

OTHER PUBLICATIONS

Official Communication issued in corresponding European Patent Application No. 25154805.3, mailed on Apr. 4, 2025, 8 pages.

* cited by examiner

*Primary Examiner* — Ngoc T Nguyen
(74) *Attorney, Agent, or Firm* — Keating & Bennett, LLP

(57) ABSTRACT

A tractor includes an engine room defined by an engine hood, an engine in the engine room, an exhaust gas cleaner in the engine room to clean exhaust gas from the engine, a controller in the engine room and configured or programmed to clean the exhaust gas, and a casing containing the controller.

5 Claims, 9 Drawing Sheets

TRACTOR

CROSS REFERENCE TO RELATED APPLICATIONS

This application claims the benefit of priority to Japanese Patent Application No. 2024-014391 filed on Feb. 1, 2024. The entire contents of this application are hereby incorporated herein by reference.

BACKGROUND OF THE INVENTION

1. Field of the Invention

The present invention relates to tractors.

2. Description of the Related Art

Japanese Unexamined Patent Application Publication, Tokukai, No. 2023-051493 discloses a tractor including an engine room defined by an engine hood, an engine in the engine room, and an exhaust gas cleaning device (corresponding to a second exhaust gas cleaning device according to example embodiments of the present invention) disposed in the engine room and configured to clean exhaust gas from the engine.

SUMMARY OF THE INVENTION

The above tractor is configured such that the exhaust gas cleaning device treats exhaust gas from the engine to reduce toxic material therein. There has been a demand for a tractor capable of reducing a large amount of toxic material.

Example embodiments of the present invention provide tractors each configured to reduce a large amount of toxic material in exhaust gas from the engine.

A tractor according to an example embodiment of the present invention includes an engine room (an engine space) defined by an engine hood, an engine in the engine room, an exhaust gas cleaner in the engine room to clean exhaust gas from the engine, a controller in the engine room and configured or programmed to clean the exhaust gas, and a casing containing the controller.

With the above configuration, the exhaust gas cleaner cleans exhaust gas from the engine to reduce toxic material therein. The casing helps prevent the controller from being wetted or heated due to heat from the engine or in the engine room. This allows the controller to appropriately control the exhaust gas cleaner to clean exhaust gas. The above configuration, in other words, allows the controller to appropriately control the exhaust gas cleaner to clean exhaust gas, regardless of heat from the engine or in the engine room or cleaning water or the like entering the engine room. This in turn allows the exhaust gas cleaner to reduce a large amount of toxic material in exhaust gas from the engine.

The tractor may further include a rotary fan positioned forward of the engine to supply engine cooling air, wherein the controller is in a back portion of the engine room and laterally outward of the engine relative to a body of the tractor.

With the above configuration, the rotary fan supplies cooling air flowing toward a back portion of the engine room. The cooling air comes into contact with the casing. This helps prevent the casing from being heated due to heat from the engine or in the engine room, which in turn helps prevent the controller from being heated and thereby allows the controller to appropriately control the exhaust gas cleaning device.

The tractor may further include a hood holding frame to which the engine hood is attached so as to be swingable to be opened and closed, wherein the casing is attached to the hood holding frame.

With the above configuration, the hood holding frame doubles as a holder of the casing. This eliminates the need for a dedicated holder of the casing for a reduced cost.

The tractor may be further configured such that the casing includes a casing body attached to the hood holding frame and holding the controller, and a casing lid to open and close the casing body and attachable to and detachable from the casing body from laterally outward relative to a body of the tractor.

The above configuration allows a worker to open the casing lid and operate the controller from laterally outward of the body. This allows for easy maintenance.

The tractor may be further configured such that the casing body includes a body edge wall extending from an edge of the casing body, the casing lid includes a lid edge wall extending from an edge of the casing lid, and with the casing body closed by the casing lid, the body edge wall and the lid edge wall overlap with each other in a direction from inward to outward relative to the casing.

With the above configuration, the body edge wall and the lid edge wall overlap with each other. This prevents dust or water from easily entering the casing through the gap between the casing body and the casing lid. This in turn protects the controller from dust or water.

The tractor may be further configured such that with the casing body closed by the casing lid, the lid edge wall is outward of the casing body relative to the body edge wall.

With the above configuration, even if there is a gap between the body edge wall and the lid edge wall, the gap faces inward along the width of the body. This prevents dust or water from easily entering the casing from laterally outward of the body. This in turn protects the controller from dust or water.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

The description below deals with example embodiments of the present invention with reference to drawings.

Figure 1:
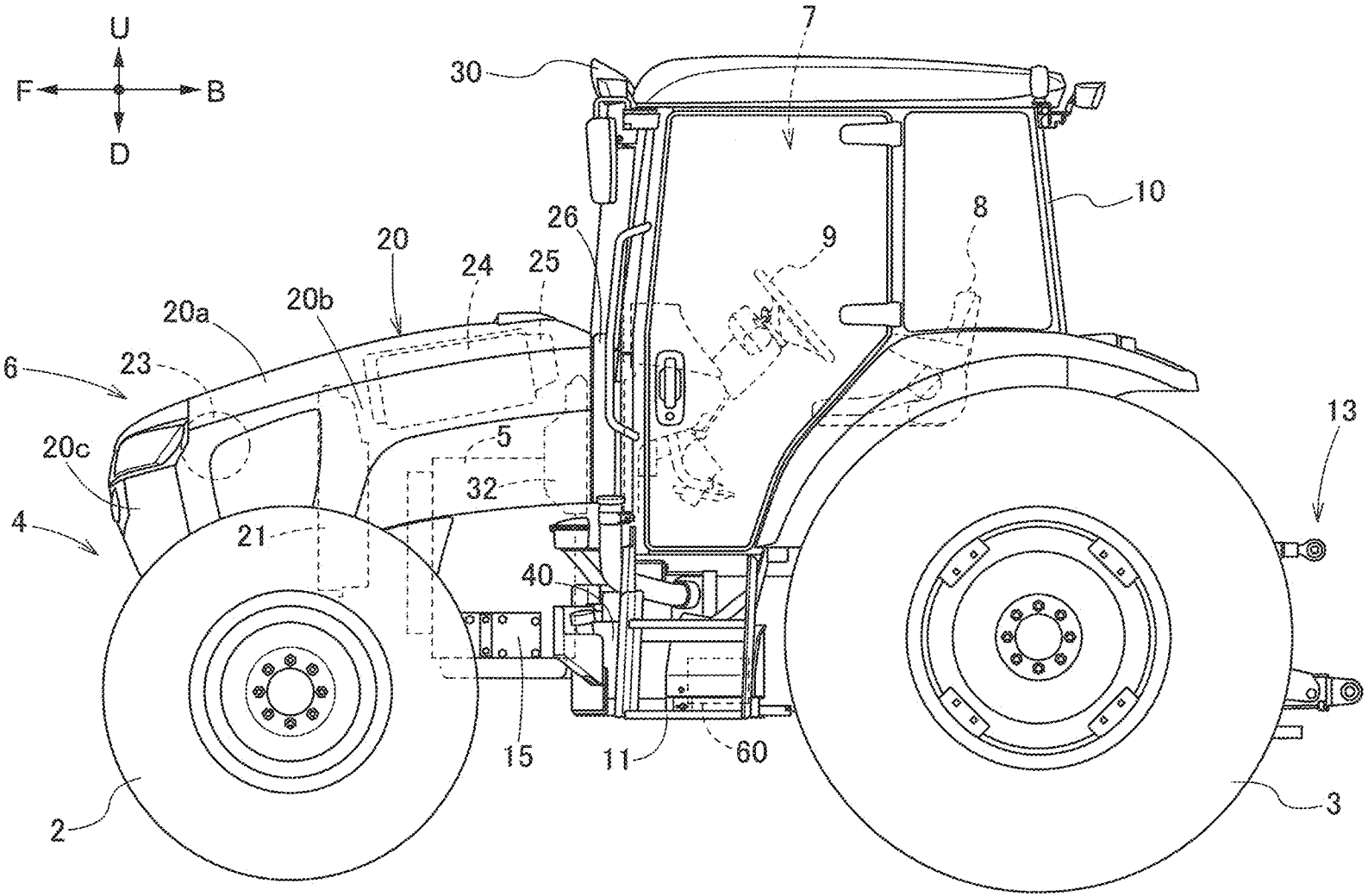
FIG. 1 is a left side view of a tractor in its entirety.
Figure 2:
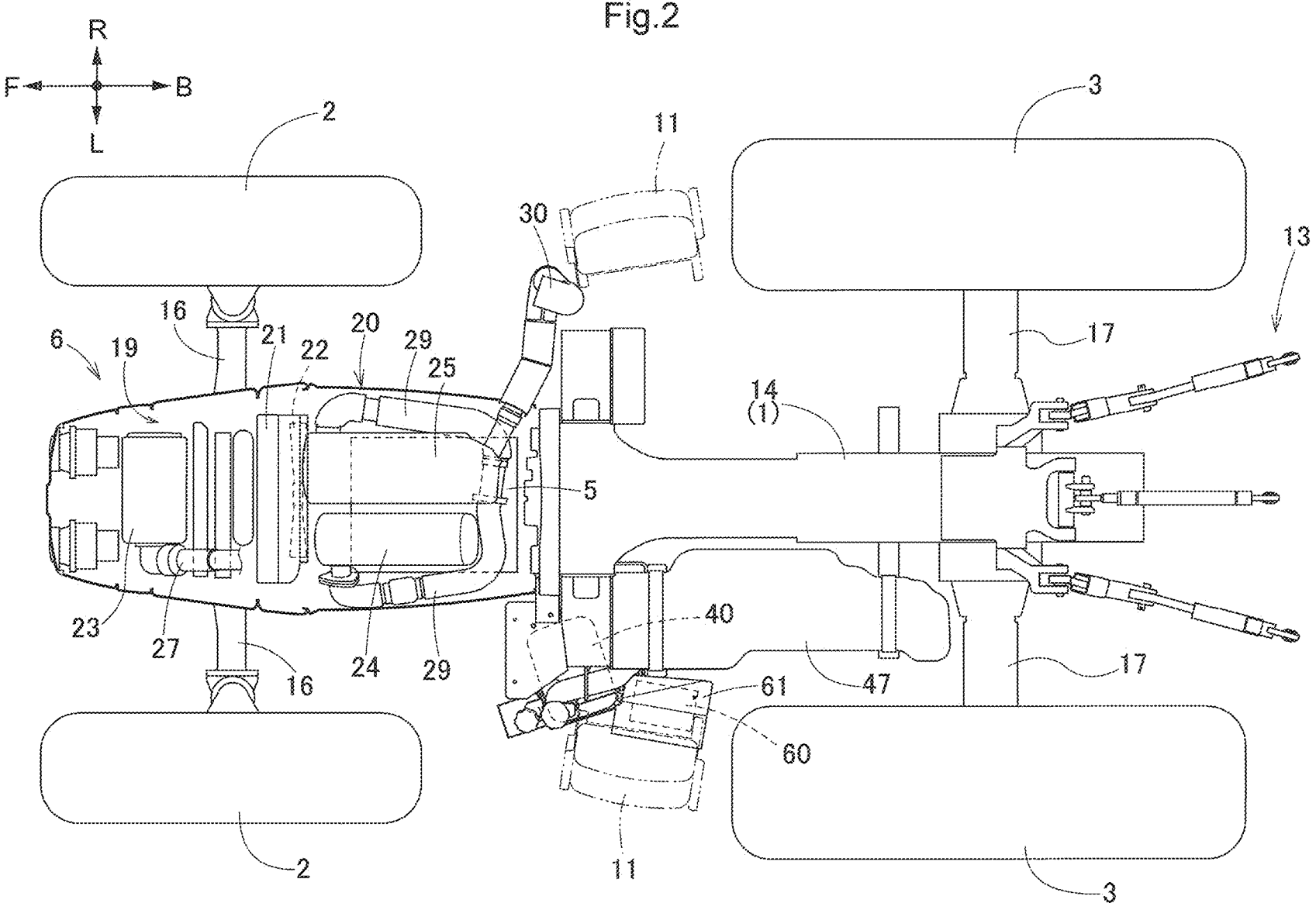
FIG. 2 is a plan view of a motor section, a section for placing a reducing agent tank, and a section for placing a reducing agent pump.
Figure 3:
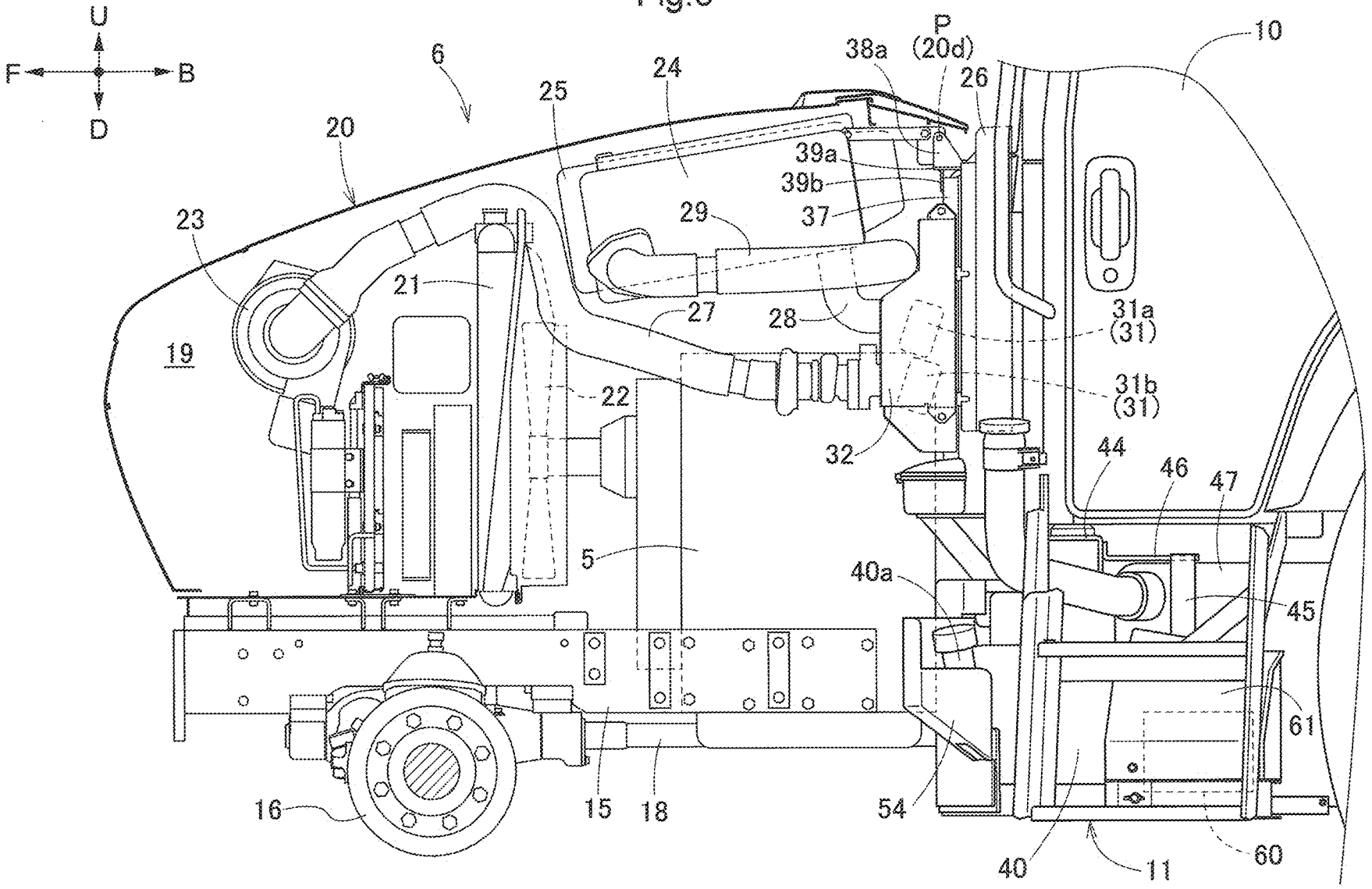
FIG. 3 is a side view of a motor section, a section for placing a reducing agent tank, and a section for placing a reducing agent pump.
Figure 5:
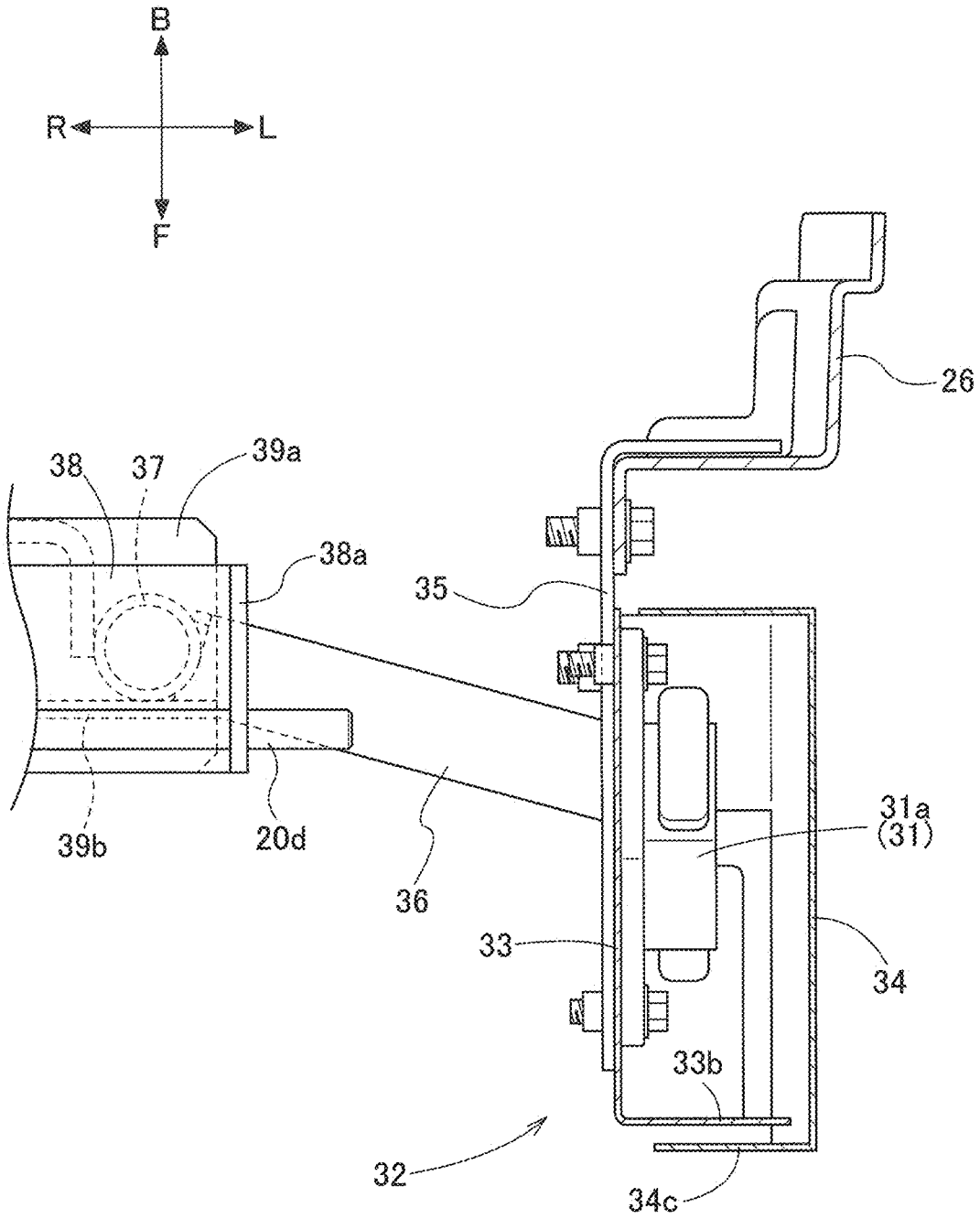
FIG. 5 is a plan view of a controller and a casing in cross section.

The example embodiments described below relate to tractors. FIGS. 1 to 3 and 5 show arrow F to indicate the forward direction relative to the vehicle body and arrow B to indicate the backward direction relative to the vehicle body. FIGS. 1 and 3 show arrow U to indicate the upward direction relative to the vehicle body and arrow D to indicate the downward direction relative to the vehicle body. FIGS. 2 and 5 show arrow L to indicate the leftward direction relative to the vehicle body and arrow R to indicate the rightward direction relative to the vehicle body. The lateral direction relative to the body corresponds to the width of the vehicle body.

FIGS. 1 and 2 each illustrate a tractor including a body 4 including a body frame 1, a pair of left and right turnable and drivable front wheels 2, and a pair of left and right drivable rear wheels 3. The tractor includes, at a front portion of the body 4, a motor section 6 including components such as an engine 5. The tractor includes at a back portion of the body 4 a driver section 7 configured to accommodate a driver. The driver section 7 includes a driver's seat 8, a steering wheel 9 for use to turn the front wheels 2, and a cabin 10 defining a driver space. The tractor includes laterally outward of the driver section 7 an entrance step 11 for a person to enter and exit the driver section 7. The tractor includes, at a back portion of the body 4, a link mechanism 13 that allows any of various work devices such as a rotary tiller device (not illustrated in the drawings) to be coupled to the body 4 so as to be capable of being lifted and lowered.

As illustrated in FIGS. 2 and 3, the body frame 1 includes such components as an engine 5, a transmission case 14 extending backward relative to the body from a back portion of the engine 5, and a front frame 15 extending forward relative to the body from a lower portion of the engine 5. The tractor includes a pair of left and right front-wheel drive cases 16 held by the front frame 15 and having respective outer ends opposite to each other along the width of the body. The front wheels 2 are attached to the respective outer ends so as to be turnable and drivable, and are held by the front frame 15 with the respective front-wheel drive cases 16 in-between. The tractor includes a pair of left and right rear-wheel drive cases 17 disposed at opposite sides of a back portion of the transmission case 14 and having respective outer ends. The rear wheels 3 are held by the respective outer ends so as to be drivable. The engine 5 transmits its output to a travel transmission (not illustrated in the drawings) in the transmission case 14. The travel transmission then transmits its output to the rear wheels 3 through the respective rear-wheel drive cases 17. The travel transmission also transmits its output to the front wheels 2 through a power transmission shaft 18 (which extends from the transmission case 14 to the front-wheel drive cases 16) and the respective front-wheel drive cases 16.

The link mechanism 13 is at a back portion of the transmission case 14.

As illustrated in FIGS. 2 and 3, the motor section 6 includes an engine room 19 defined by such components as an engine hood 20. The motor section 6 includes in the engine room 19 a diesel engine 5, a radiator 21 to cool the engine 5, a rotary fan 22 to cool the engine 5, an air cleaner 23 for the engine 5, a first exhaust gas cleaner 24, and a second exhaust gas cleaner 25.

As illustrated in FIG. 3, the tractor includes a pair of left and right hood holding frames 37 and a pair of left and right pivot shafts 20*d*. The hood holding frames 37 are each disposed in a back portion of the engine room 19 and each extend vertically relative to the body. The engine hood 20 has a back portion coupled to the hood holding frames 37 with the respective pivot shafts 20*d* in-between. The hood holding frames 37 extend upward from the body frame 1 in respective opposite lateral sides of a back portion of the engine room 19. The tractor includes a pair of left and right shaft supports 38 each including a bent end 38*a* supporting those ends of the corresponding pivot shaft 20*d* which are opposite to each other along the width of the body. The tractor includes a pair of left and right first couplers 39*a* each extending along the lower face of the corresponding shaft support 38 and a pair of left and right second couplers 39*b* each coupling the corresponding first coupler 39*a* to the corresponding hood holding frame 37. As illustrated in FIGS. 3 and 5, the pivot shafts 20*d* are attached to the respective hood holding frames 37 as the shaft supports 38 are each coupled to an upper portion of the corresponding hood holding frame 37 with the corresponding first and second couplers 39*a* and 39*b* in-between. The engine hood 20 is held by the hood holding frames 37 so as to be swingable upward and downward to be opened and closed about a pivot axis P of each pivot shaft 20*d* which pivot axis P extends along the width of the body. The engine hood 20 includes a top plate 20*a*, a pair of left and right side plates 20*b* extending downward from respective opposite side portions of the top plate 20*a*, and a front plate 20*c* coupled to respective front end portions of the top plate 20*a* and the side plates 20*b*.

As illustrated in FIGS. 2 and 3, the engine 5 is in a back portion of the engine room 19. The rotary fan 22 is forward of the engine 5. The radiator 21 is forward of the rotary fan 22. The engine 5 transmits its output to the rotary fan 22 to drive the rotary fan 22. The rotary fan 22 rotates to cause cooling air to flow backward from forward of the radiator 21 so that the radiator 21 receives the cooling air. The cooling air cools engine cooling water of the radiator 21. The radiator 21 supplies the engine cooling water to the engine 5 to cool the engine 5.

As illustrated in FIGS. 2 and 3, the air cleaner 23 is forward of the radiator 21 and is connected to the engine 5 through an air supply duct 27. The air cleaner 23 for the present example embodiment is connected to a supercharger (not illustrated in the drawings) provided for the engine 5.

As illustrated in FIGS. 2 and 3, the first and second exhaust gas cleaners 24 and 25 are above the engine 5. The first and second exhaust gas cleaners 24 and 25 for the present example embodiment are arranged along the width of the body, and each have a longitudinal direction along the front-back direction relative to the body.

The engine 5 includes an exhaust gas discharging section (not illustrated in the drawings). The first exhaust gas cleaner 24 includes an exhaust gas introducing section (not illustrated in the drawings). The tractor includes a first exhaust gas introducing duct 28 connecting the exhaust gas discharging section to the exhaust gas introducing section. The exhaust gas introducing section for the present example embodiment is at a lower back portion of the first exhaust gas cleaner 24. The first exhaust gas cleaner 24 is configured to receive exhaust gas from the engine 5 through the first exhaust gas introducing duct 28 and clean the exhaust gas.

Specifically, the first exhaust gas cleaner 24 performs its cleaning process by collecting fine diesel particles in the exhaust gas with use of a collecting filter (not shown in the drawings) to reduce the number of fine diesel particles.

As illustrated in FIGS. 2 and 3, the first exhaust gas cleaner 24 includes an exhaust gas jetting section. The second exhaust gas cleaner 25 includes an exhaust gas introducing section. The tractor includes a second exhaust gas introducing duct 29 connecting the exhaust gas jetting section to the exhaust gas introducing section. The tractor includes an exhaust pipe 30 extending from the exhaust gas jetting section. The first exhaust gas cleaner 24 includes an exhaust gas jetting section at a front side portion facing away from the second exhaust gas cleaner 25. The second exhaust gas cleaner 25 includes an exhaust gas introducing section at a front side portion facing away from the first exhaust gas cleaner 24. The second exhaust gas introducing duct 29 extends from the exhaust gas jetting section of the first exhaust gas cleaner 24 through a space lateral to the first exhaust gas cleaner 24, a space backward of the first and second exhaust gas cleaners 24 and 25, and a space lateral to the second exhaust gas cleaner 25 to the exhaust gas introducing section of the second exhaust gas cleaner 25. The second exhaust gas cleaner 25 is configured to receive exhaust gas from the engine 5 through components such as the second exhaust gas introducing duct 29 and clean the exhaust gas.

Specifically, the second exhaust gas introducing duct 29 includes a reducing agent injecting section (not illustrated in the drawings). The second exhaust gas introducing duct 29 for the present example embodiment includes a reducing agent injecting section at a portion lateral to the second exhaust gas cleaner 25 and extending in the front-back direction relative to the body. The second exhaust gas cleaner 25 is configured to receive through the second exhaust gas introducing duct 29 exhaust gas discharged from the engine 5 and cleaned by the first exhaust gas cleaner 24. The reducing agent injecting section injects a reducing agent into the second exhaust gas introducing duct 29 and thereby mixes the reducing agent with exhaust gas to be introduced into the second exhaust gas cleaner 25 to clean the exhaust gas. More specifically, the reducing agent for the present example embodiment is an aqueous urea solution. Injecting the aqueous urea solution into the exhaust gas causes pyrolysis and hydrolysis to generate ammonia, which chemically reacts with an nitrogen oxide in the exhaust gas for reduction into nitrogen and water. This reduces the amount of the nitrogen oxide in the exhaust gas to clean the exhaust gas. The second exhaust gas cleaner 25 discharges the cleaned exhaust gas through the exhaust pipe 30 out of the tractor.

The tractor includes a controller 31 configured or programmed to control the exhaust gas cleaning process of the second exhaust gas cleaner 25 to reduce more of a nitrogen oxide.

The tractor includes a casing 32. As illustrated in FIG. 3, the controller 31 is contained in the casing 32 in the engine room 19. The controller 31 for the present example embodiment is in a back portion of the engine room 19 and laterally outward of the engine 5 relative to the body, and is easily susceptible to engine cooling air flowing backward relative to the body from the rotary fan 22 through a space between the engine 5 and the engine hood 20. The controller 31 for the present example embodiment is outward to the left of the engine 5 relative to the body. The controller 31 may alternatively be outward to the right of the engine 5 relative to the body.

The controller 31 is configured or programmed to (i) receive information on a detection result from, for example, a nitrogen oxide sensor (not illustrated in the drawings) configured to detect the amount of a nitrogen oxide contained in exhaust gas that the second exhaust gas cleaner 25 has cleaned and (ii) cause a computer to control the cleaning process based on the detection result which computer is configured or programmed to control an engine controller or an exhaust gas cleaner. The controller 31 may alternatively be configured or programmed to perform a cleaning process for, based on a detection result from a nitrogen oxide sensor, adjusting the amount of the reducing agent to be injected by the reducing agent injecting section.

Figure 4:
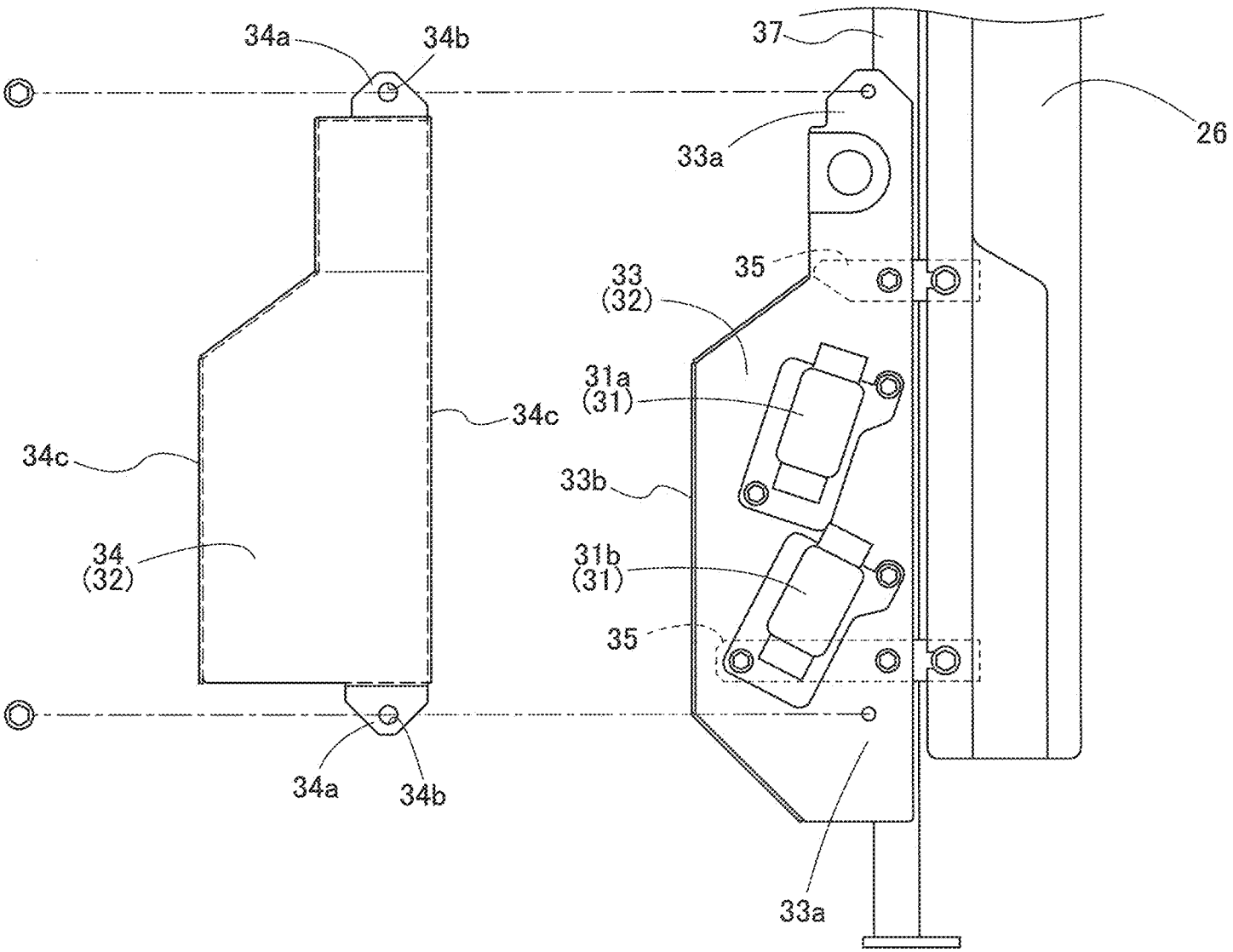
FIG. 4 is a side view of a controller and a casing with a casing lid removed.

The casing 32 is, as illustrated in FIGS. 3, 4, and 5, attached to one of the hood holding frames 37. The hood holding frame 37 doubles as a holder of the casing 32.

Specifically, as illustrated in FIGS. 4 and 5, the casing 32 includes a casing body 33 and a casing lid 34. The controller 31 is attached to the casing body 33. The tractor includes two casing holders 35 coupled to respective upper and lower portions of the casing body 33 and a holding arm 36 extending laterally outward relative to the body from the hood holding frame 37 and coupled to the casing holders 35. The casing body 33 is attached to the hood holding frame 37 with the casing holders 35 and the holding arm 36 in-between. The casing body 33 is detachably coupled to the casing holders 35 with use of coupling bolts. The casing holders 35 are welded to the holding arm 36. The tractor includes a resin cover 26 attached to respective back portions of the casing holders 35 and covering the gap between the engine hood 20 and a front wall portion of the cabin 10. The casing body 33 and the casing lid 34 may each be structured in view of another component in the engine hood 20. For example, as illustrated in FIGS. 3 and 4, the casing body 33 and the casing lid 34 are each structured to have an upper left portion so bent inward as to avoid contact with the second exhaust gas introducing duct 29.

The casing lid 34 is configured to open and close the casing body 33. Specifically, the casing lid 34 includes two couplers 34*a* at respective upper and lower portions and two coupling holes 34*b* in the respective couplers 34*a*. The casing lid 34 is placed on the casing body 33 from laterally outward relative to the body as illustrated in FIG. 5. The couplers 34*a* are then detachably coupled to respective holders 33*a* of the casing body 33 with use of coupling bolts. This attaches the casing lid 34 to the casing body 33 and closes the casing body 33. Removing the coupling bolts uncouples the casing lid 34 from the casing body 33. Then removing the casing lid 34 from the casing body 33 laterally outward relative to the body opens the casing body 33.

As illustrated in FIGS. 4 and 5, the casing body 33 includes a body edge wall 33*b* extending laterally outward relative to the body from the edge of the casing body 33, whereas the casing lid 34 includes a lid edge wall 34*c* extending from the edge of the casing lid 34 toward the casing body 33. The casing lid 34, which includes a lid edge wall 34*c*, prevents the controller 31 from receiving water from above and consequently becoming broken down. The lid edge wall 34*c* may, as illustrated in FIG. 4, be open at a lower left portion of the casing lid 34 (that is, to the left of the coupler 34*a* at a lower right portion of the casing lid 34) to easily let out water, unnecessary straw, and weeds that have entered the casing 32. With the casing body 33 closed with the casing lid 34 as illustrated in FIG. 5, the body edge wall 33*b* and the lid edge wall 34*c* overlap with each other at a front portion of the casing 32 in a direction from inward to outward relative to the casing 32. The body edge wall 33*b* and the lid edge wall 34*c* reduce the amount of dust entering the casing 32 which dust comes from forward of the casing 32 due to, for example, cooling air from the rotary fan 22. The body edge wall 33*b* and the lid edge wall 34*c* also reduce the amount of hot air entering the casing 32 which hot air results from cooling air from the rotary fan 22 cooling the engine 5 and flows from forward of the casing 32. The present example embodiment is configured such that the lid edge wall 34*c* is outward of and overlaps with the body edge wall 33*b*. The lid edge wall 34*c* may alternatively be inward of and overlap with the body edge wall 33*b*.

As illustrated in FIGS. 1 to 3, the tractor includes at a laterally outward portion of the body frame 1 a reducing agent tank 40 configured to store a reducing agent to be supplied to the reducing agent injecting section and a reducing agent pump 60 configured to draw the reducing agent from the reducing agent tank 40 and supply the reducing agent to the reducing agent injecting section. The tractor includes a tank cover 41 covering the reducing agent tank 40 and a pump cover 61 covering the reducing agent pump 60. The tank cover 41 and the pump cover 61 protect the reducing agent tank 40 and the reducing agent pump 60, respectively, from flying stones and the like. The reducing agent tank 40 and the reducing agent pump 60 for the present example embodiment are on a left outer portion of the body frame 1. The reducing agent tank 40 and the reducing agent pump 60 may alternatively be on a right outer portion of the body frame 1. The reducing agent tank 40 and the reducing agent pump 60 for the present example embodiment are inward of the entrance step 11. The entrance step 11 doubles as a guard for the reducing agent tank 40 and the reducing agent pump 60.

Figure 6:
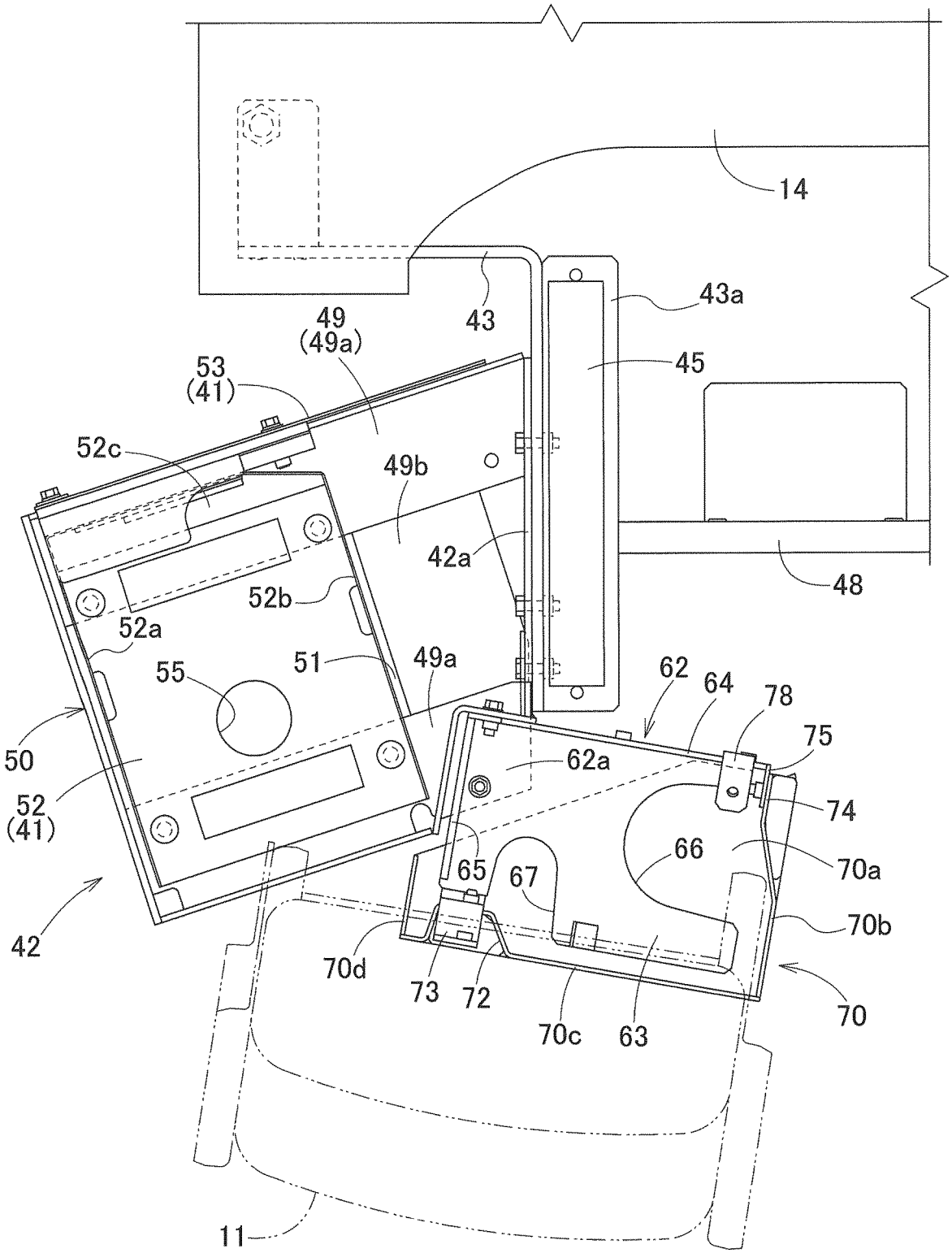
FIG. 6 is a plan view of a tank holder and a pump holder.

The tractor includes a tank holder 42 holding the reducing agent tank 40 as illustrated in FIG. 6 and held by the body frame 1. As illustrated in FIG. 6, the tractor includes a holding arm 43 protruding laterally outward relative to the body from the transmission case 14 of the body frame 1. The tank holder 42 has a back portion 42*a* coupled to the holding arm 43 to be held by the body frame 1. The tank holder 42 is coupled to the holding arm 43 with use of coupling bolts. The tractor includes a cabin supporting frame 44, a first coupler 45, and a second coupler 46 (see FIG. 3). The cabin supporting frame 44 protrudes laterally outward relative to the body from the transmission case 14 and supporting the cabin 10. The holding arm 43 and the cabin supporting g frame 44 are coupled to each other with the first and second couplers 45 and 46 in-between to reinforce the coupling of the holding arm 43 to the transmission case 14. The first coupler 45 is in the shape of an arch surrounding a fuel tank 47 (see FIG. 2) for the engine 5 as viewed in the front-back direction, and extends from a bent portion 43*a* of the holding arm 43. The second coupler 46 couples an upper portion of the first coupler 45 to the cabin supporting frame 44. The holding arm 43 has an intermediate portion along the width of the body which intermediate portion is coupled to a back portion of the transmission case 14 with a coupling bar 48 in-between for reinforcement of the coupling of the holding arm 43 to the transmission case 14.

Figure 7:
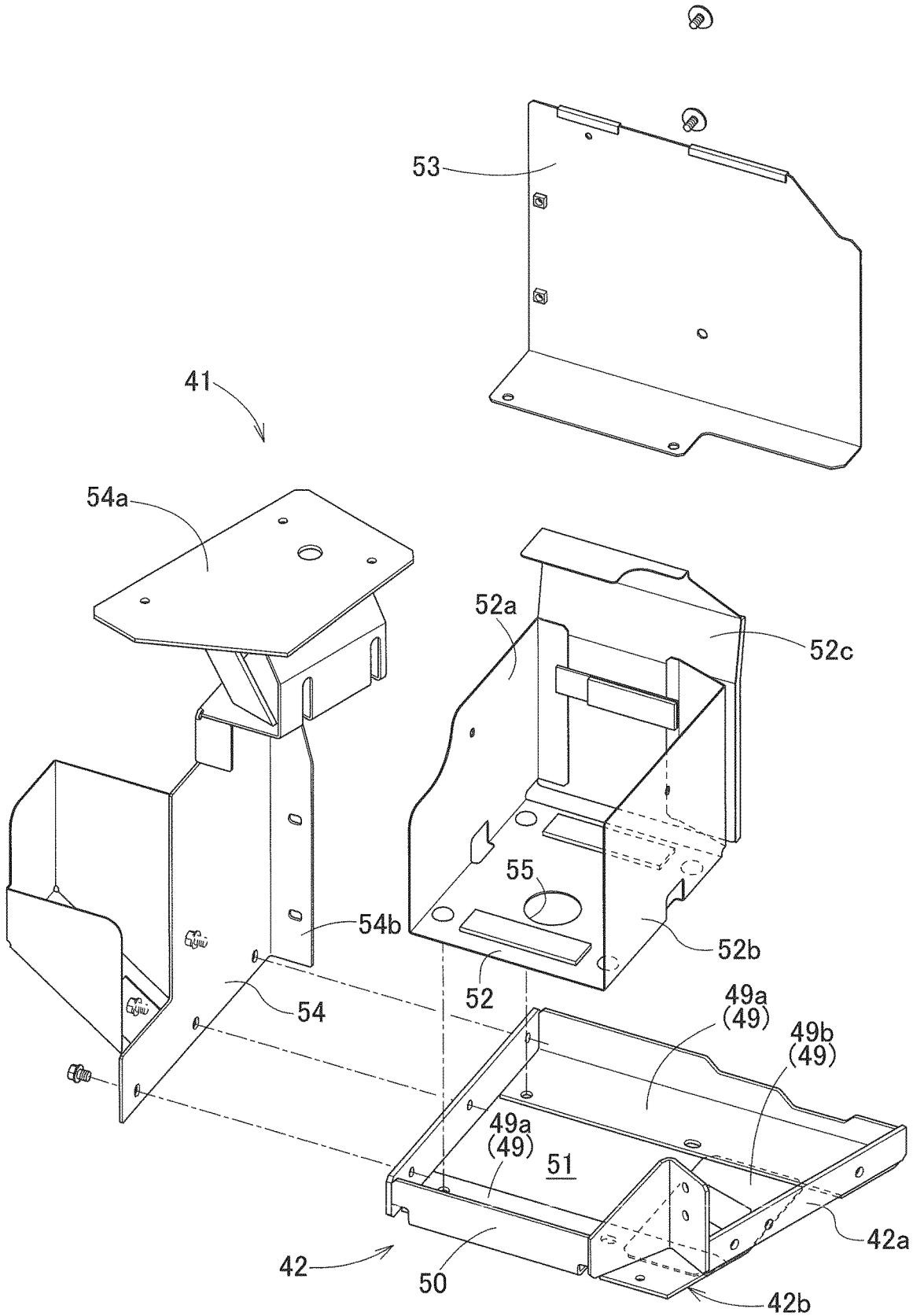
FIG. 7 is a perspective view of a tank holder and a tank cover as exploded.

As illustrated in FIGS. 6 and 7, the tank holder 42 includes a tank placement section 49 and a frame 50 extending from the edge of the tank placement section 49.

The tank holder 42 holds the reducing agent tank 40 as a result of placing the reducing agent tank 40 on the tank placement section 49 and pressing the reducing agent tank 40 from above with use of a fixing member (not illustrated in the drawings) to fix the reducing agent tank 40 to the tank placement section 49.

As illustrated in FIGS. 6 and 7, the tank placement section 49 includes two placement plates 49*a* and a coupling plate 49*b* coupling respective ends of the placement plates 49*a*. The tank placement section 49 has a rectangular opening 51 facing a drain cock (not illustrated in the drawings) on a bottom portion of the reducing agent tank 40. The opening 51 allows a worker to open and close the drain cock from below the tank holder 42.

As illustrated in FIGS. 6 and 7, the tank cover 41 includes a bottom cover section 52, a lateral cover section 53, and a front cover section 54. The bottom cover section 52 is on the tank placement section 49 to cover the reducing agent tank 40 from below. The lateral cover section 53 is inward of the reducing agent tank 40 along the width of the body to cover the reducing agent tank 40 from the side of the body frame 1. The front cover section 54 is forward of the reducing agent tank 40 to cover the reducing agent tank 40 from forward. The bottom cover section 52 includes a front vertical cover portion 52*a* between the reducing agent tank 40 and the front cover section 54, a back vertical cover portion 52*b* covering the reducing agent tank 40 from backward, and a side vertical cover portion 52*c* between the reducing agent tank 40 and the lateral cover section 53. The front cover section 54 includes at an upper portion a coupler 54*a* coupled to the body frame 1 to be held by the body frame 1. The front cover section 54 includes a holder 54*b*. The lateral cover section 53 is coupled to the holder 54*b* with use of coupling screws to be held by the front cover section 54. The bottom cover section 52 has an opening 55 facing the drain cock on a bottom portion of the reducing agent tank 40. The opening 55 is circular and smaller than the opening 51 in the tank placement section 49. The openings 51 and 55 allow a worker to open and close the drain cock from below the tank holder 42. The front cover section 54 has a cutout through which a reducing agent supply cylinder 40*a* (see FIG. 3) extends forward from the reducing agent tank 40.

The reducing agent tank 40 is on a left outer portion of the body frame 1 and inward of the entrance step 11, and is fixed to the tank placement section 49 of the tank holder 42 to be held by the tank holder 42. The reducing agent tank 40 is held by the transmission case 14 of the body frame 1 with the tank holder 42 and the holding arm 43 in-between. The reducing agent tank 40 as held by the tank holder 42 is covered by the tank cover 41. Even with the reducing agent tank 40 held by the tank holder 42 and covered by the tank cover 41, the above configuration allows a worker to operate the drain cock from below the tank holder 42 through the opening 51 in the tank placement section 49 and the opening 55 in the bottom cover section 52 to pull out the reducing agent from the reducing agent tank 40.

Figure 8:
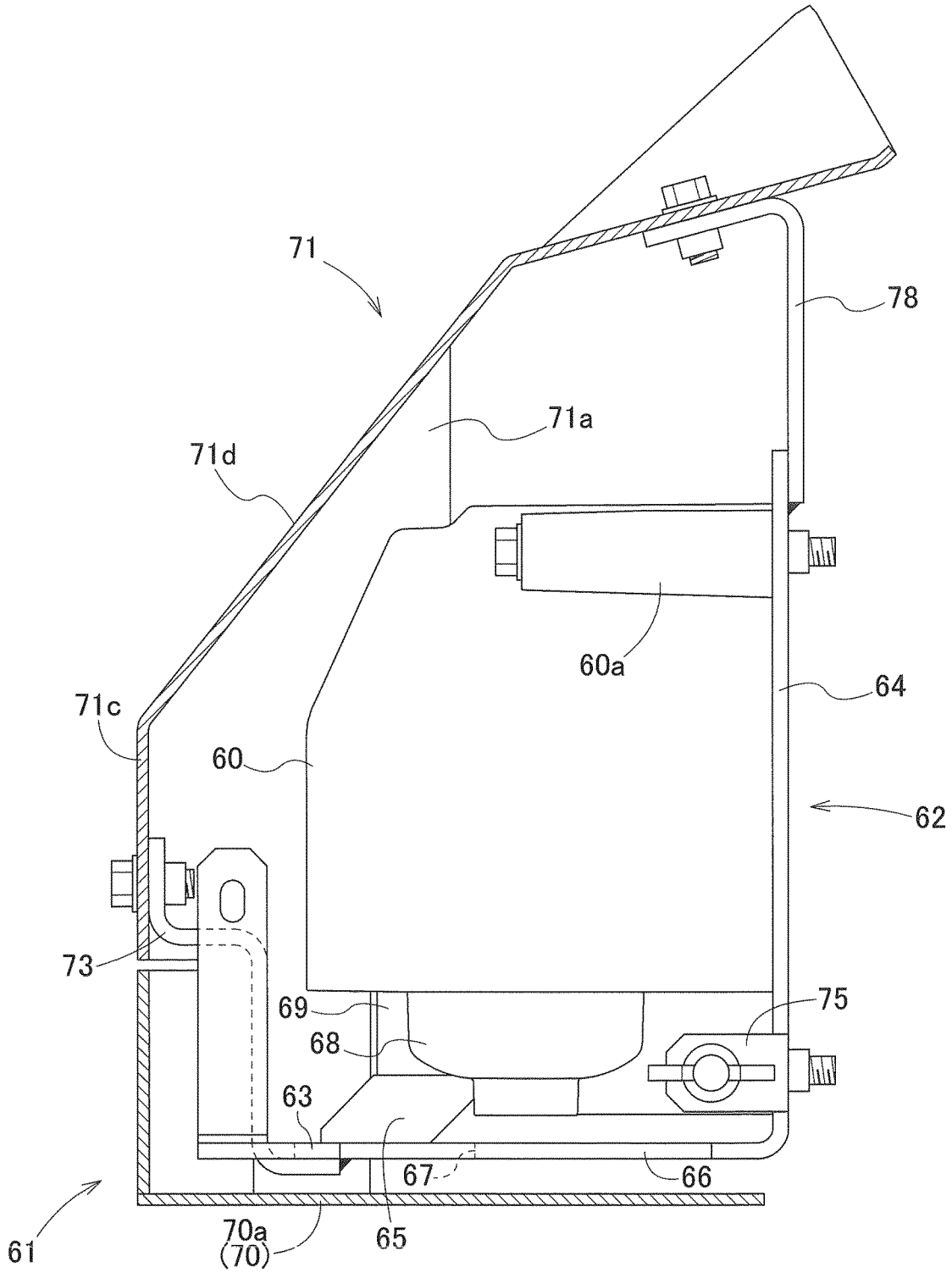
FIG. 8 is a rear view of a reducing agent pump and a pump cover in cross section.

As illustrated in FIG. 8, the tractor includes a pump holder 62 holding the reducing agent pump 60 and supported by the body frame 1. As illustrated in FIG. 6, the pump holder 62 has a front portion 62*a* coupled to a holder 42*b* of the tank holder 42 so that the pump holder 62 is supported by the body frame 1. The tank holder 42 is coupled to the pump holder 62 with use of coupling bolts. The pump holder 62 is held by the transmission case 14 of the body frame 1 with the tank holder 42 and the holding arm 43 in-between. The tank holder 42 doubles as a structure to couple the pump holder 62 to the body frame 1.

Figure 9:
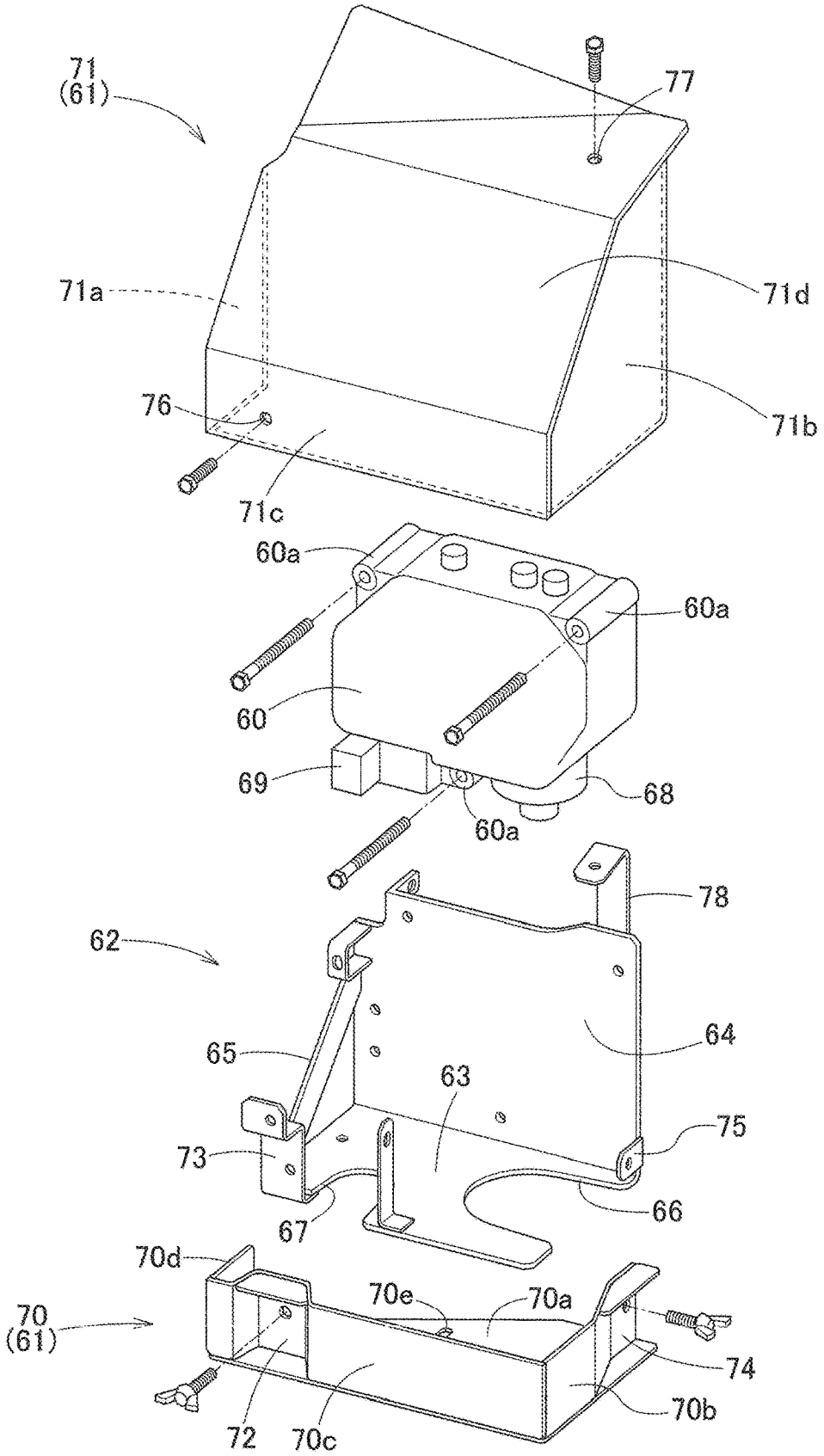
FIG. 9 is a perspective view of a reducing agent pump, a pump holder, and a pump cover as removed.

As illustrated in FIGS. 6 and 9, the pump holder 62 includes a bottom plate 63, a side vertical plate 64, and a front vertical plate 65. The side vertical plate 64 extends from a lateral end portion of the edge of the bottom plate 63 which lateral end portion faces the body frame 1. The front vertical plate 65 extends from a front end portion of the edge of the bottom plate 63. The front vertical plate 65 has a height smaller than the height of the side vertical plate 64.

As illustrated in FIG. 8, the pump holder 62 holds the reducing agent pump 60 as a result of placing the reducing agent pump 60 above the bottom plate 63, inserting two coupling bolts through respective attachment holes in attachment sections 60*a* at upper and lower portions of the reducing agent pump 60, and engaging the coupling bolts with the side vertical plate 64 to fasten the attachment sections 60*a* to the side vertical plate 64 with use of the coupling bolts.

As illustrated in FIGS. 6 and 9, the bottom plate 63 has a first maintenance opening 66 and a second maintenance opening 67. The first and second maintenance openings 66 and 67 for the present example embodiment are each in the form of a cutout. The form is, however, not limited to a cutout. The first and second maintenance openings 66 and 67 may alternatively be each in the form of a through hole with any of various shapes such as circular, elliptical, and rectangular. The reducing agent pump 60 includes a maintenance section 68 (see FIGS. 8 and 9) at a bottom portion. The first maintenance opening 66 is at a portion of the bottom plate 63 which portion faces the maintenance section 68. The first maintenance opening 66 allows a worker to perform work on the maintenance section 68 from below the pump holder 62. The maintenance section 68 for the present example embodiment is for a filter (not illustrated in the drawings) to allow a worker to pull out and insert a filter for cleaning and replacement. The maintenance section 68 is, however, not necessarily for a filter, and may alternatively be for a pump component other than a filter. The reducing agent pump 60 includes a terminal section 69 (see FIG. 9) at a side portion. The second maintenance opening 67 is at a portion of the bottom plate 63 which portion faces the terminal section 69. The second maintenance opening 67 allows a worker to perform work on the terminal section 69 from below the pump holder 62 which work is, for example, engaging and disengaging a lock mechanism of a connector (not illustrated in the drawings) connected to the terminal section 69.

The pump cover 61, as illustrated in FIGS. 8 and 9, includes a lower cover section 70 and an upper cover section 71 separable from each other.

As illustrated in FIG. 9, the lower cover section 70 includes a bottom plate 70*a*, a back vertical plate 70*b*, a side vertical plate 70*c*, and a front vertical plate 70*d*. The back vertical plate 70*b* extends from a back end portion of the edge of the bottom plate 70*a*. The side vertical plate 70*c* extends from a side end portion of the edge of the bottom plate 70*a* which side end portion is laterally outward relative to the body. The front vertical plate 70*d* extends from a front end portion of the edge of the bottom plate 70*a*. The bottom plate 70*a* has two or more drainage holes 70*e*.

As illustrated in FIGS. 6 and 8, the lower cover section 70 covers a lower portion of the reducing agent pump 60 and is held by the pump holder 62 as a result of placing the lower cover section 70 below the pump holder 62, detachably coupling, with use of a coupling bolt, a front coupler 72 at a front portion of the side vertical plate 70*c* to a lower portion of an attachment arm 73 extending upward from the bottom plate 63 of the pump holder 62, and detachably coupling, with use of a coupling bolt, a back coupler 74 at a lateral end portion of the back vertical plate 70*b* to an attachment section 75 provided for the bottom plate 63 of the pump holder 62.

As illustrated in FIG. 9, the upper cover section 71 includes a front vertical plate 71*a*, a back vertical plate 71*b*, a side vertical plate 71*c*, and a top plate 71*d*. The top plate 71*d* is inclined downward in a direction laterally outward relative to the body.

As illustrated in FIG. 8, the upper cover section 71 covers a portion of the reducing agent pump 60 above the lower cover section 70 and is held by the pump holder 62 as a result of placing the upper cover section 71 above the reducing agent pump 60, detachably coupling, with use of a coupling bolt through a coupling hole 76, a front portion of the side vertical plate 71*c* to an upper portion of the attachment arm 73, and detachably coupling, with use of a coupling bolt through a coupling hole 77, a back lateral end portion of the top plate 71*d* to an attachment arm 78 extending upward from the side vertical plate 64 of the pump holder 62.

The lower and upper cover sections 70 and 71 are attached to the pump holder 62 and coupled to each other to define a pump cover 61 as a whole covering the reducing agent pump 60. The present example embodiment is configured such that the reducing agent pump 60 is covered from inward along the width of the body by not the pump cover 61 but the side vertical plate 64 of the pump holder 62.

As illustrated in FIG. 8, the pump cover 61 covers the reducing agent pump 60 as follows. The bottom plate 70*a* of the lower cover section 70 is below the reducing agent pump 60 and faces a bottom portion of the reducing agent pump 60 such that the lower cover section 70 covers the reducing agent pump 60 from below. The bottom plate 63 of the pump holder 62 is between the bottom plate 70*a* of the lower cover section 70 and the bottom portion of the reducing agent pump 60 such that the lower cover section 70 covers the first and second maintenance openings 66 and 67 in the bottom plate 63. The lower cover section 70 prevents dust and the like from entering the reducing agent pump 60 through the first and second maintenance openings 66 and 67.

The reducing agent pump 60 is on a left outer portion of the body frame 1 and inward of the entrance step 11, and is held by the pump holder 62. The reducing agent pump 60 is held by the transmission case 14 of the body frame 1 with the pump holder 62, the tank holder 42, and the holding arm 43 in-between. The reducing agent pump 60 as held by the pump holder 62 is covered by the pump cover 61. With the reducing agent pump 60 held by the pump holder 62, removing only the lower cover section 70 of the pump cover 61 from the pump holder 62 removes the lower cover section 70 from the first and second maintenance openings 66 and 67 in the pump holder 62 to allow a worker to perform work on the maintenance section 68 from below the pump holder 62 through the first maintenance opening 66 and on the terminal section 69 from below the pump holder 62 through the second maintenance opening 67.

Alternative Example Embodiments (1) The example embodiments described above are examples in which the controller 31 is configured or programmed to control the cleaning process of the second exhaust gas cleaner 25 and not the process of the first exhaust gas cleaner 24. The controller 31 may alternatively be configured or programmed to control the cleaning process of each of the first and second exhaust gas cleaners 24 and 25.

(2) The example embodiments described above are examples in which the controller 31 is configured or programmed to includes a first controller section 31*a* and a second controller section 31*b*. The controller 31 may alternatively be configured or programmed to include a single controller section or three or more controller sections.

(3) The example embodiments described above are examples in which the controller 31 is in the engine room 19 and laterally outward of the engine 5 relative to the body. The present invention is, however, not limited to such a configuration. The controller 31 may be at any position in the engine room 19.

(4) The example embodiments described above are examples in which the casing 32 is attached to one of the hood holding frames 37. The present invention is, however, not limited to such a configuration. The casing 32 may be attached to and held by any component such as a dedicated holder of the casing 32.

(5) The example embodiments described above are examples in which the casing lid 34 is detachable. The casing lid 34 may alternatively be swingable or slidable to be opened and closed.

(6) The example embodiments described above are examples including a lid edge wall 34*c* and a body edge wall 33*b*. The present invention may alternatively include only either of the lid edge wall 34*c* and the body edge wall 33*b*.

(7) The example embodiments described above are examples in which the lid edge wall 34*c* and the body edge wall 33*b* overlap with each other in a direction from inward to outward relative to the casing 32 with the lid edge wall 34*c* outward of the casing body 33. The lid edge wall 34*c* and the body edge wall 33*b* may alternatively overlap with each other in that direction with the lid edge wall 34*c* inward of the casing body 33.

Example embodiments of the present invention are applicable to any tractor including an exhaust gas cleaner in the engine room.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A tractor comprising:

an engine space defined by an engine hood;

an engine in the engine space;

an exhaust gas cleaner in the engine space to clean exhaust gas from the engine;

a controller in the engine space and configured or programmed to clean the exhaust gas;

a casing containing the controller; and a rotary fan positioned forward of the engine to supply engine cooling air; wherein the controller is in a back portion of the engine space and laterally outward of the engine relative to a body of the tractor.

2. A tractor comprising:

an engine space defined by an engine hood;

an engine in the engine space;

an exhaust gas cleaner in the engine space to clean exhaust gas from the engine;

a controller in the engine space and configured or programmed to clean the exhaust gas;

a casing containing the controller; and a hood holding frame to which the engine hood is attached so as to be swingable to be opened and closed; wherein the casing is attached to the hood holding frame.

3. The tractor according to claim 2, wherein the casing includes:

a casing body attached to the hood holding frame and holding the controller; and a casing lid to open and close the casing body and attachable to and detachable from the casing body from laterally outward relative to a body of the tractor.

4. The tractor according to claim 3, wherein the casing body includes a body edge wall extending from an edge of the casing body;

the casing lid includes a lid edge wall extending from an edge of the casing lid; and with the casing body closed by the casing lid, the body edge wall and the lid edge wall overlap with each other in a direction from inward to outward relative to the casing.

5. The tractor according to claim 4, wherein with the casing body closed by the casing lid, the lid edge wall is outward of the casing body relative to the body edge wall.

* * * * *